US008328621B2

(12) United States Patent
Kim

(10) Patent No.: US 8,328,621 B2
(45) Date of Patent: Dec. 11, 2012

(54) GAMING SYSTEM AND A METHOD OF GAMING

(75) Inventor: Hyong Joo Kim, Meadowbank (AU)

(73) Assignee: Aristocrat Technologies Australia Pty Limited, North Ryde, NSW (AU)

( * ) Notice: Subject to any disclaimer, the term of this patent is extended or adjusted under 35 U.S.C. 154(b) by 546 days.

(21) Appl. No.: 12/276,012

(22) Filed: Nov. 21, 2008

(65) Prior Publication Data

US 2009/0186682 A1 Jul. 23, 2009

(30) Foreign Application Priority Data

Nov. 23, 2007 (AU) ..... 2007906424

(51) Int. Cl.
*A63F 9/24* (2006.01)

(52) U.S. Cl. ..... 463/20; 463/22

(58) Field of Classification Search ..... 463/16–42; 273/292, 138.1
See application file for complete search history.

(56) References Cited

U.S. PATENT DOCUMENTS

| | | | | |
|---|---|---|---|---|
| 6,234,897 | B1 * | 5/2001 | Frohm et al. | 463/20 |
| 7,018,293 | B2 * | 3/2006 | Brown et al. | 463/20 |
| 7,252,591 | B2 * | 8/2007 | Van Asdale | 463/22 |
| 2002/0003335 | A1 * | 1/2002 | Schaefer et al. | 273/139 |
| 2004/0023714 | A1 | 2/2004 | Asdale | |
| 2006/0030387 | A1 | 2/2006 | Jackson | |
| 2006/0030396 | A1 | 2/2006 | Marks et al. | |
| 2009/0069071 | A1 * | 3/2009 | Aoki et al. | 463/20 |
| 2009/0131145 | A1 * | 5/2009 | Aoki et al. | 463/20 |

FOREIGN PATENT DOCUMENTS

| | | |
|---|---|---|
| JP | 2007105239 | 4/2007 |
| WO | 0237208 | 5/2002 |

* cited by examiner

*Primary Examiner* — Masud Ahmed
(74) *Attorney, Agent, or Firm* — Hanley, Flight & Zimmerman, LLC

(57) ABSTRACT

A method of gaming including: displaying at least one symbol which comprises a visible symbol and a hidden symbol; locating an overlay on the at least one symbol; and determining whether the overlay makes the hidden symbol visible.

17 Claims, 8 Drawing Sheets

GAMING SYSTEM AND A METHOD OF GAMING

CROSS-REFERENCE TO RELATED APPLICATIONS

The present application claims the benefit of priority to Australian Provisional Patent Application No. 2007906424, filed on Nov. 23, 2007, entitled "A GAMING SYSTEM AND A METHOD OF GAMING", which is herein incorporated by reference in its entirety.

FIELD OF THE INVENTION

This invention relates to a gaming system, a method of gaming, a game controller and computer program code.

BACKGROUND OF THE INVENTION

Many different gaming systems are known in which symbols are displayed in order to provide a game on which a wager can be made. Typically such games are played on so-called "poker machines". Usually the symbols are displayed on a mechanical reel, or in more recent times on a video display. A winning game is determined based on the displayed symbols.

While such gaming systems provide users with enjoyment, a need exists for an alternative gaming system in order to maintain or increase player enjoyment.

SUMMARY OF THE INVENTION

Certain embodiments of the present invention may be said to reside in a method of gaming including:

- displaying at least one symbol which includes a visible symbol and a hidden symbol;
- locating an overlay on the at least one symbol; and
- determining whether the overlay makes the hidden symbol visible.

In one embodiment, the overlay includes a transparent window of a predetermined colour and the hidden symbol is a different colour to the predetermined colour, the visible symbol being the same colour as the predetermined colour.

In one embodiment, the at least one symbol includes a plurality of symbols, at least one of the plurality of symbols including the visible symbol and the hidden symbol, the symbols being arranged in a reel format having a plurality of reel strips each including some of the symbols to thereby form at least one row of symbols.

In one embodiment, the plurality of symbols, including the visible symbol, form a group of symbols to determine a game outcome, and the overlay, when located on the hidden symbol, modifies the game outcome.

In one embodiment, the overlay includes an overlay on a reel strip overlaying one of the said reel strips.

In another embodiment, the overlay includes a roaming overlay.

Certain embodiments of the invention may also be said to reside in a game controller for a gaming system, the game controller arranged to:

- display at least one symbol which includes a visible symbol and a hidden symbol;
- locate an overlay on the at least one symbol; and
- determine whether the overlay makes the hidden symbol visible.

In one embodiment, the overlay includes a transparent window of a predetermined colour and the hidden symbol is a different colour to the predetermined colour, the visible symbol being the same colour as the predetermined colour.

In one embodiment, the at least one symbol includes a plurality of symbols, at least one of the plurality of symbols including the visible symbol and the hidden symbol, the symbols being arranged in a reel format having a plurality of reel strips each including some of the symbols to thereby form at least one row of symbols.

In one embodiment, the plurality of symbols, including the visible symbol, form a group of symbols to determine a game outcome, and the overlay, when located on the hidden symbol, modifies the game outcome.

In one embodiment, the overlay includes an overlay on a reel strip overlaying one of the said reel strips.

In another embodiment, the overlay includes a roaming overlay.

In an embodiment, the controller is implemented by a processor executing program code stored in a memory.

In a further aspect, certain embodiments of the invention provides a gaming system including:

- a player interface including a display for displaying game outcomes, and a gaming controller arranged to:
  - display at least one symbol which includes a visible symbol and a hidden symbol;
- locate an overlay on the at least one symbol; and
- determine whether the overlay makes the hidden symbol visible.

In one embodiment, the overlay includes a transparent window of a predetermined colour and the hidden symbol is a different colour to the predetermined colour, the visible symbol being the same colour as the predetermined colour.

In one embodiment, the at least one symbol includes a plurality of symbols, at least one of the plurality of symbols including the visible symbol and the hidden symbol, the symbols being arranged in a reel format having a plurality of reel strips each including some of the symbols to thereby form at least one row of symbols.

In one embodiment, the plurality of symbols, including the visible symbol, form a group of symbols to determine a game outcome, and the overlay, when located on the hidden symbol, modifies the game outcome.

In one embodiment, the overlay includes an overlay on a reel strip overlaying one of the said reel strips.

In another embodiment, the overlay includes a roaming overlay.

In a still further aspect, certain embodiments of the invention provide a computer program code which, when executed, implements the above method.

In a still further aspect, certain embodiments of the invention provide a computer readable medium including the above program.

Certain embodiments of the invention also provide a data signal having the computer program code embodied therein.

Certain embodiments of the invention also extend to transmitting the program code.

BRIEF DESCRIPTION OF THE DRAWINGS

Certain embodiments of the invention will be described, by way of example, with reference to the accompanying drawings in which.

Figure 1:
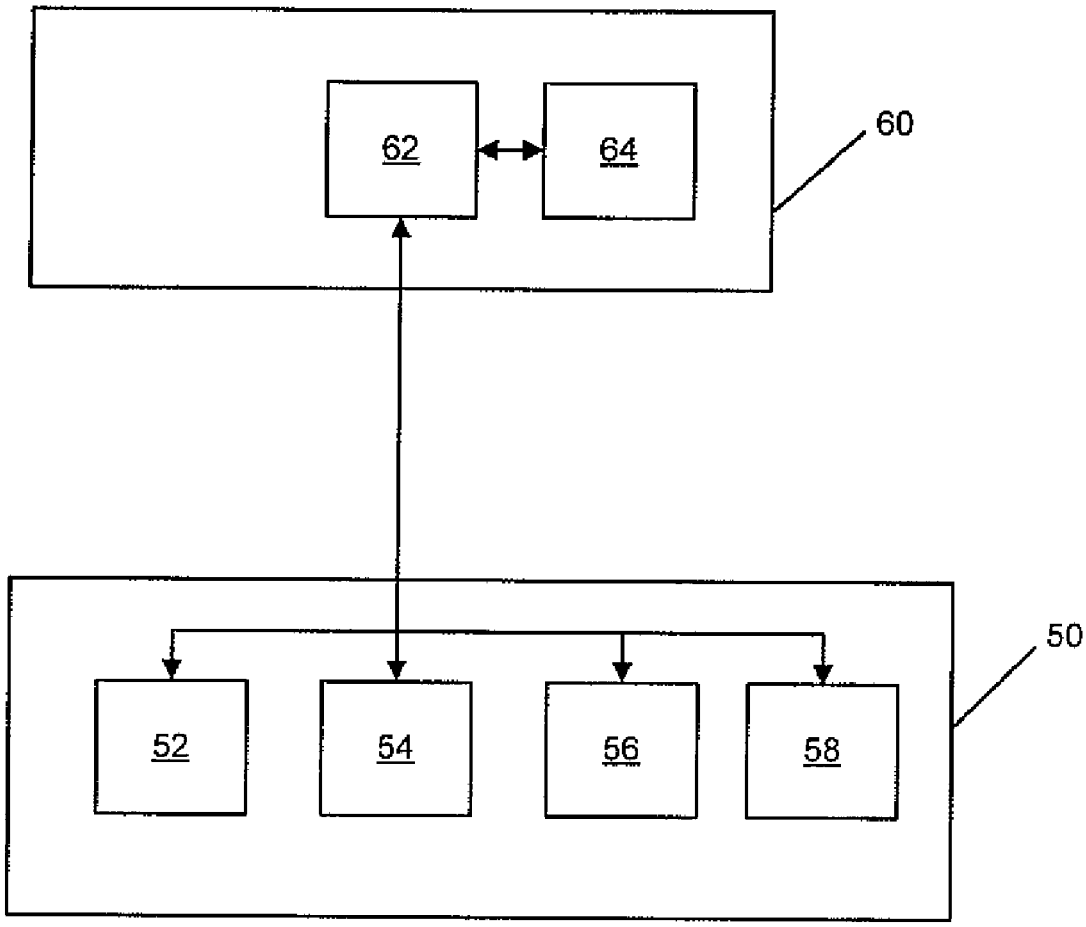
FIG. 1 is a block diagram of the core components of a gaming system.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF CERTAIN EMBODIMENTS

Referring to the drawings, there is shown a gaming system arranged to implement a game where a transparent overlay can reveal a hidden symbol. The gaming system can take a number of different forms.

In a first form, a stand alone gaming machine is provided wherein all or most components for implementing the game are present in a player operable gaming machine.

In a second form, a distributed architecture is provided wherein some of the components for implementing the game are present in a player operable gaming machine and some of the components for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system includes several core components. At the broadest level, the core components are a player interface 50 and a game controller 60 as illustrated in FIG. 1. The player interface is arranged to enable manual interaction between a player and the gaming system and for this purpose includes the input/output components for the player to enter instructions and play the game.

Components of the player interface may vary from embodiment to embodiment but will typically include a credit mechanism 52 to enable a player to input credits and receive payouts, one or more displays 54, a game play mechanism 56 that enables a player to input game play instructions (e.g., to place bets), and one or more speakers 58.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g., a PC) or a server.

Figure 2:
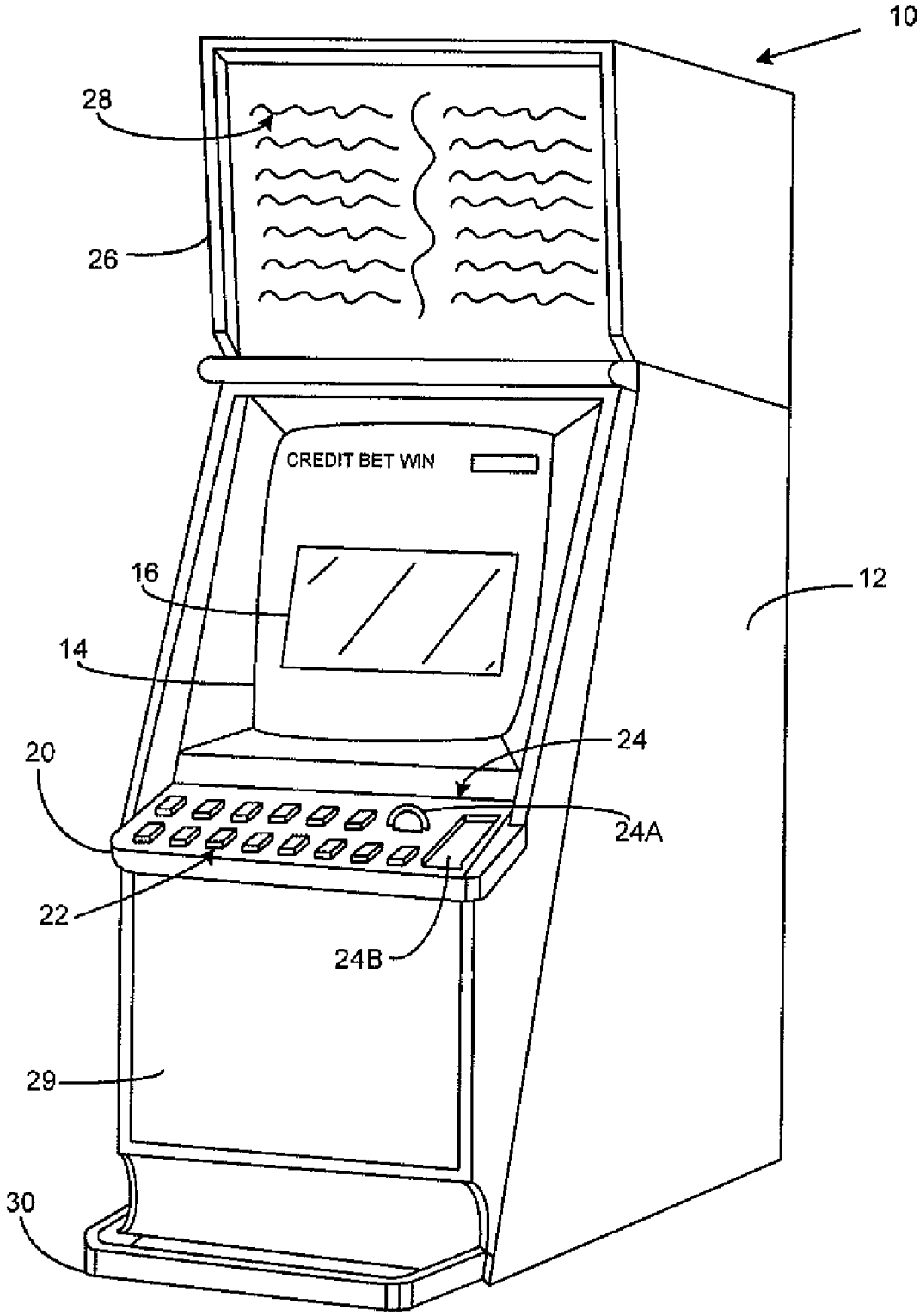
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module (not shown) having a reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
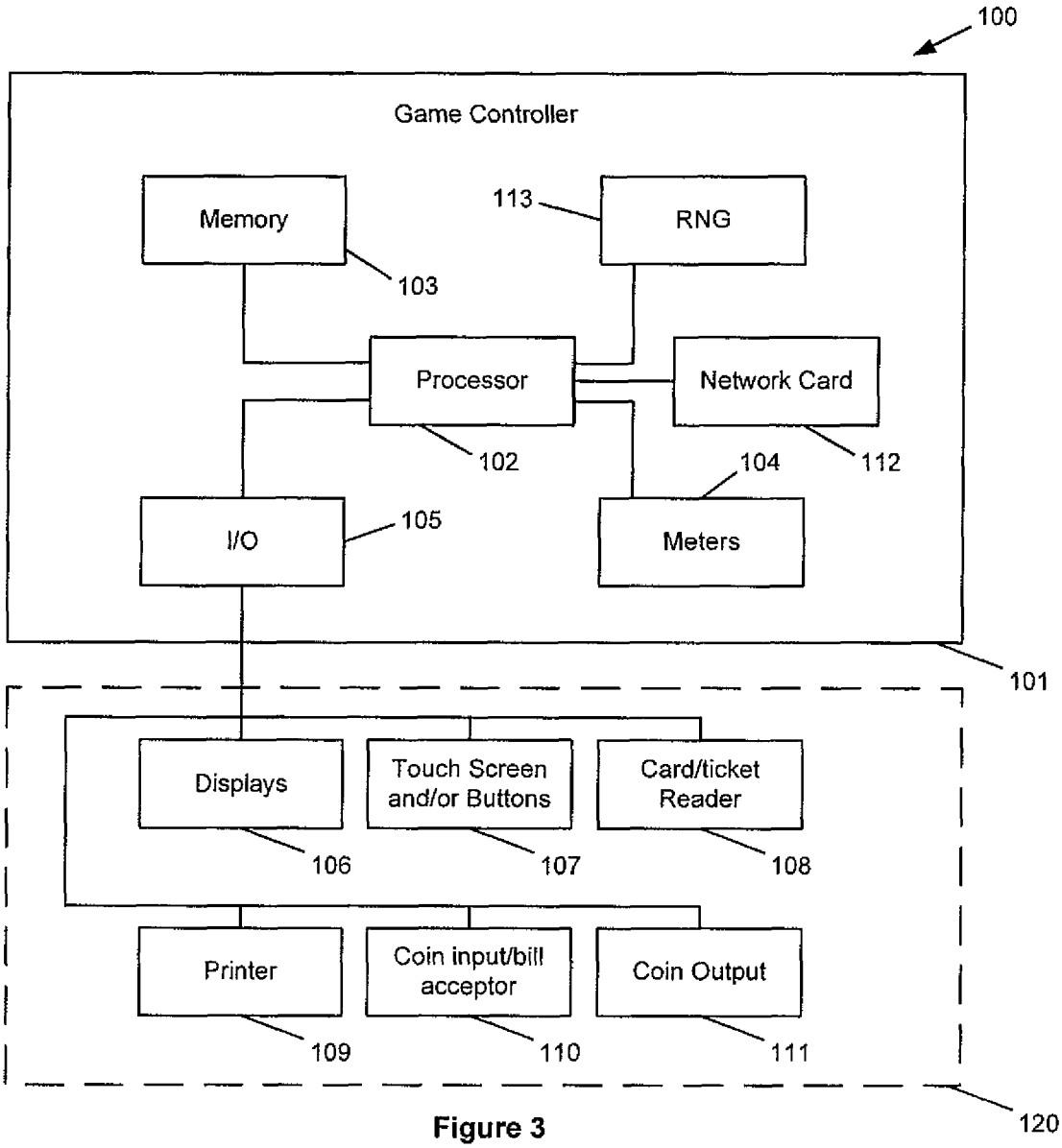
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 include one or more displays 106, a touch screen and/or buttons 107, a card and/or ticket reader 108, a printer 109, a bill acceptor and/or coin input mechanism 110 and a coin output mechanism 111. Additional hardware may be included as part of the gaming machine 100, or hardware may be omitted depending upon the specific implementation.

In addition, the gaming machine 100 may include a communications interface, for example a network card 112. The network card may, for example, send status information, accounting information or other information to a central controller, server or database and receive data or commands from the central controller, server or database.

Figure 4:
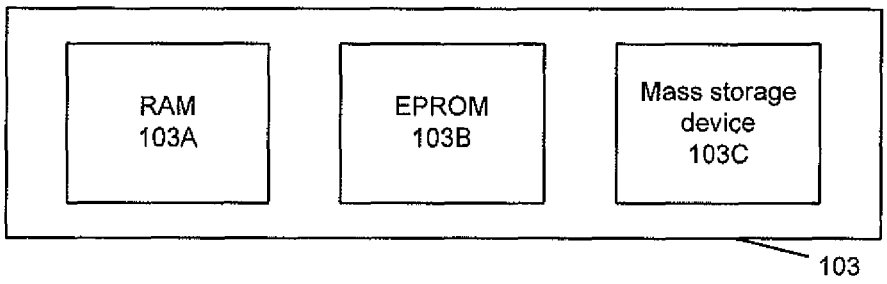
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106, 107, 108, 109, 110, 111 to be provided remotely from the game controller 101.

Figure 5:
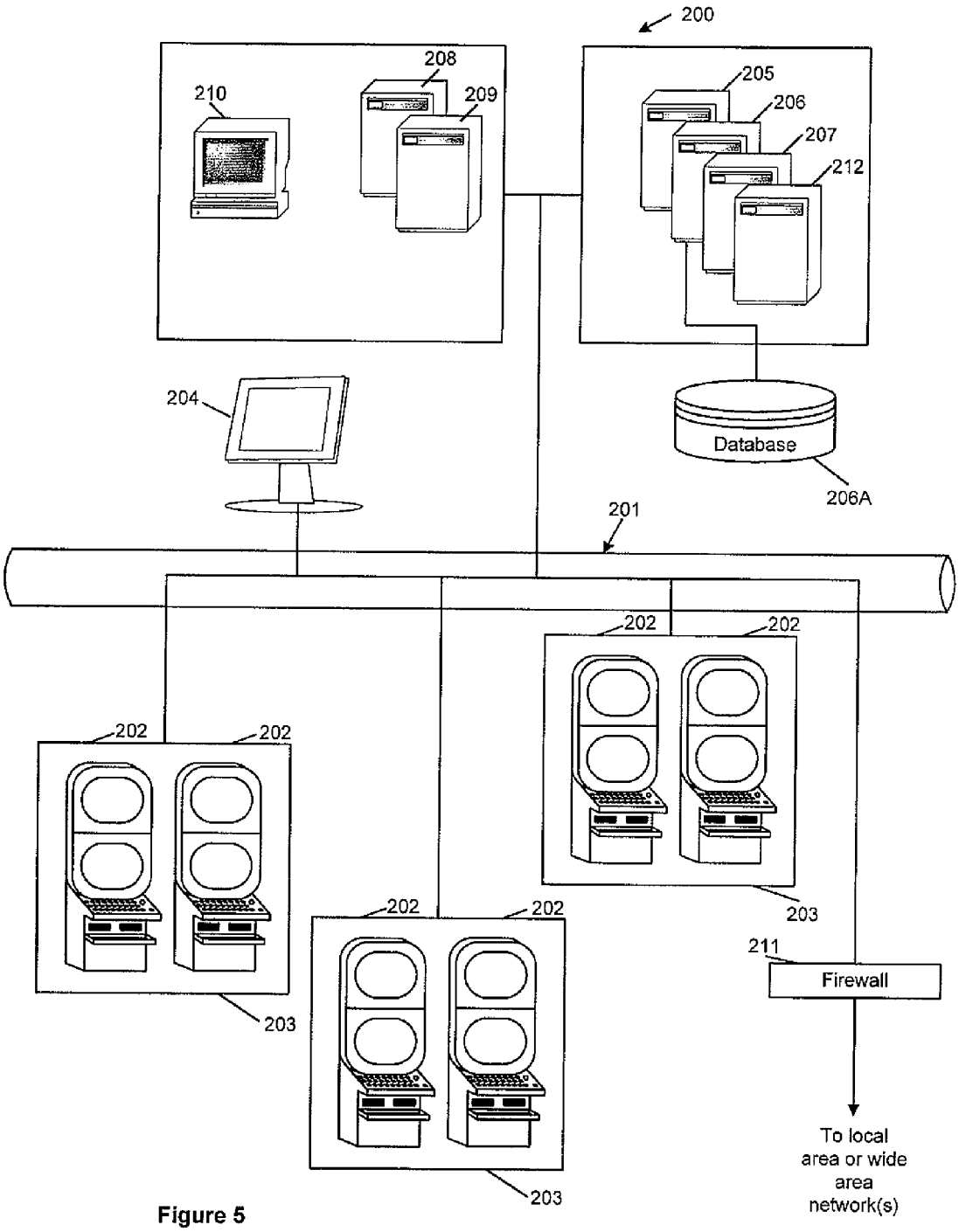
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10, 100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g., PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of games servers could be provided to run different games or a single game server may run a plurality of different games depending upon the terminals.

Persons skilled in the art will also appreciate that the method of the embodiment could be embodied in program code which can be executed by a processor to implement the game controller 60. The program code could be supplied in a number of ways, for example on a computer readable medium, such as a disc or a memory (for example, that could replace part of memory 103) or as a data signal (for example, by downloading it from a server).

Figure 6:
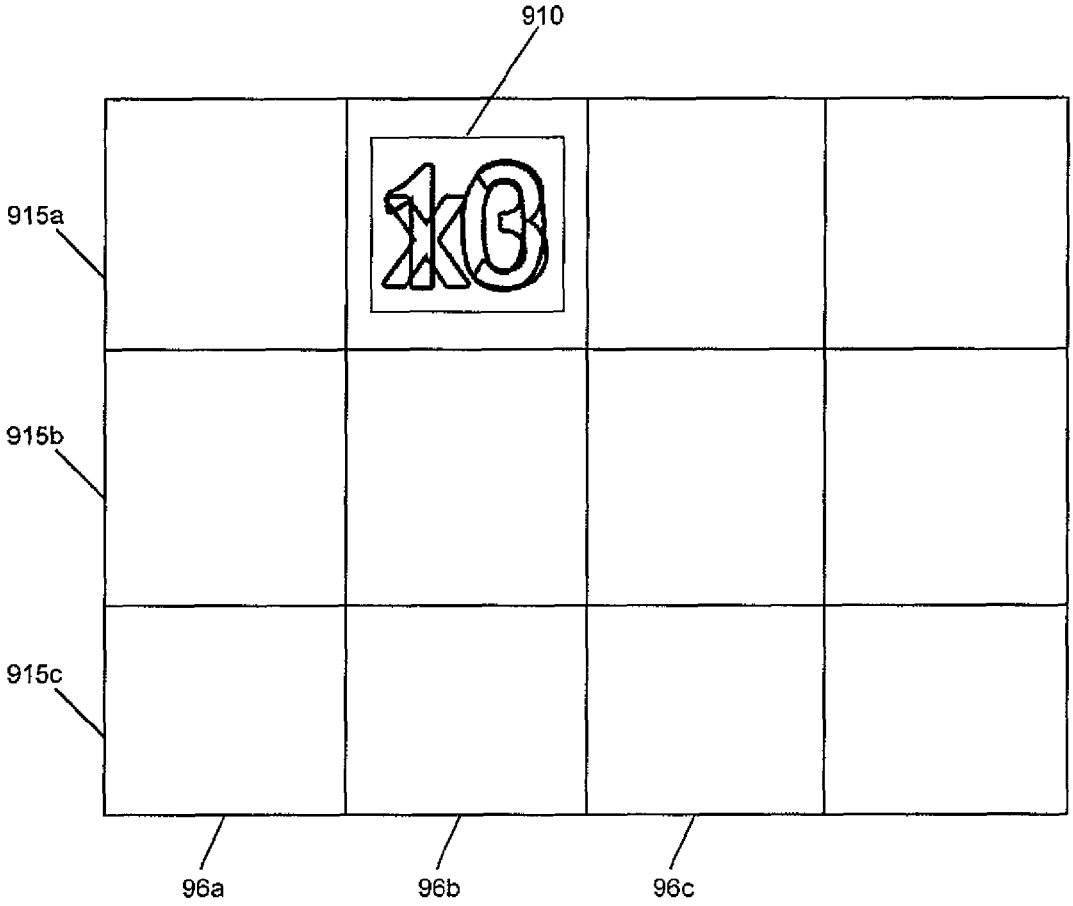
FIG. 6 is a view of a symbol according to one embodiment of the invention.
Figure 7:
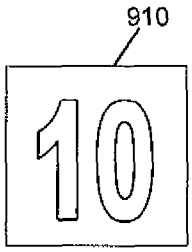
FIG. 7 is a view of the symbol of FIG. 6 as is actually observed by a player.

With reference to FIG. 6, the embodiment of the invention provides at least one symbol as shown in FIG. 6 which includes a visible symbol and a hidden symbol. In FIG. 6, both the hidden and visible symbol are shown for illustrative purposes. However, the symbol 910 as shown in FIG. 7 when actually viewed in real life would only show the numeral 10 with the X3 being hidden underneath the numeral 10 and also any background behind the numeral 10.

Figure 8:
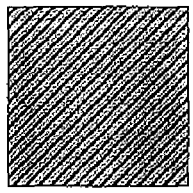
FIG. 8 is a view of the symbol of FIG. 6 having a transparent window overlaid on the symbol.

FIG. 8 shows an overlay in the form of a transparent window 12 which can be overlaid on the symbol 910 so that the hidden symbol X3 is visible.

In one particular embodiment of the invention the numeral 10 and the symbol 910 may be blue in colour and the hidden symbol X3 may be red in colour and disguised behind the numeral 10 and the background of numeral 10 as previously mentioned.

The transparent window 912 is a transparent blue window so that when the transparent window 912 is overlaid on the symbol 910, the blue numeral 10 effectively disappears thereby making the red X3 symbol visible. The X3 symbol designates a win which results in a payout, or an additional payout to a player.

Figure 9:
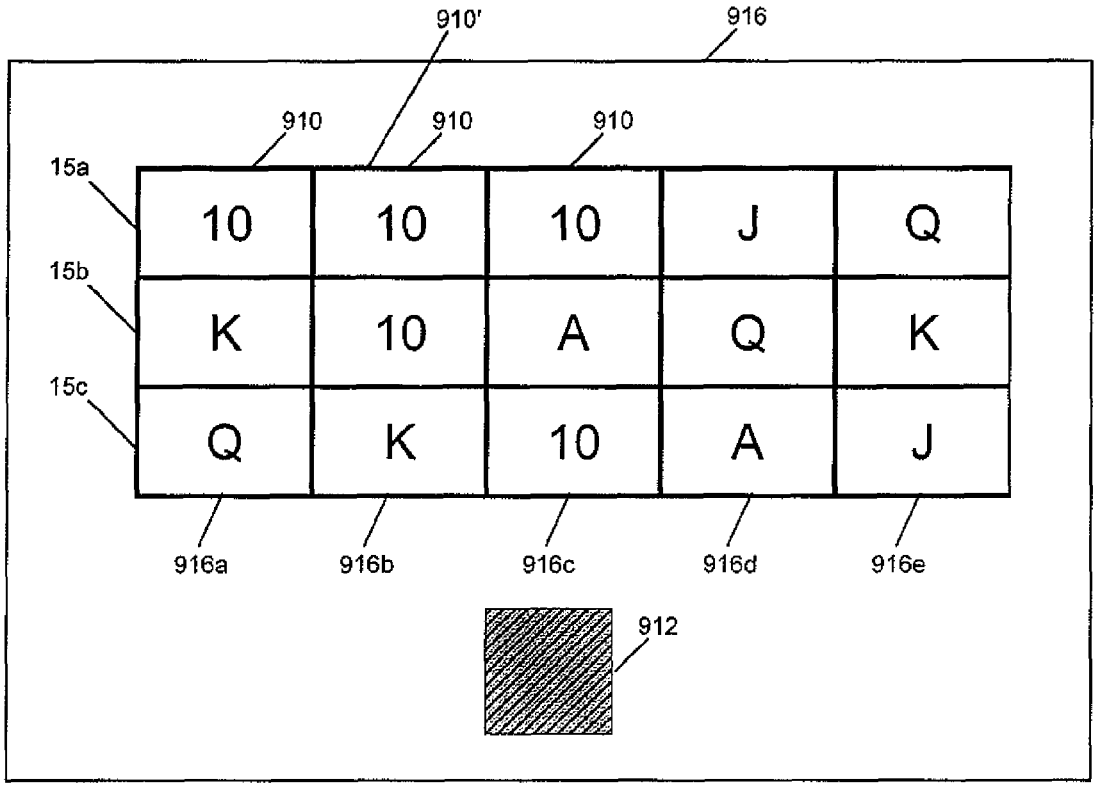
FIG. 9 is a view of a display according to an embodiment of the invention.
Figure 11:
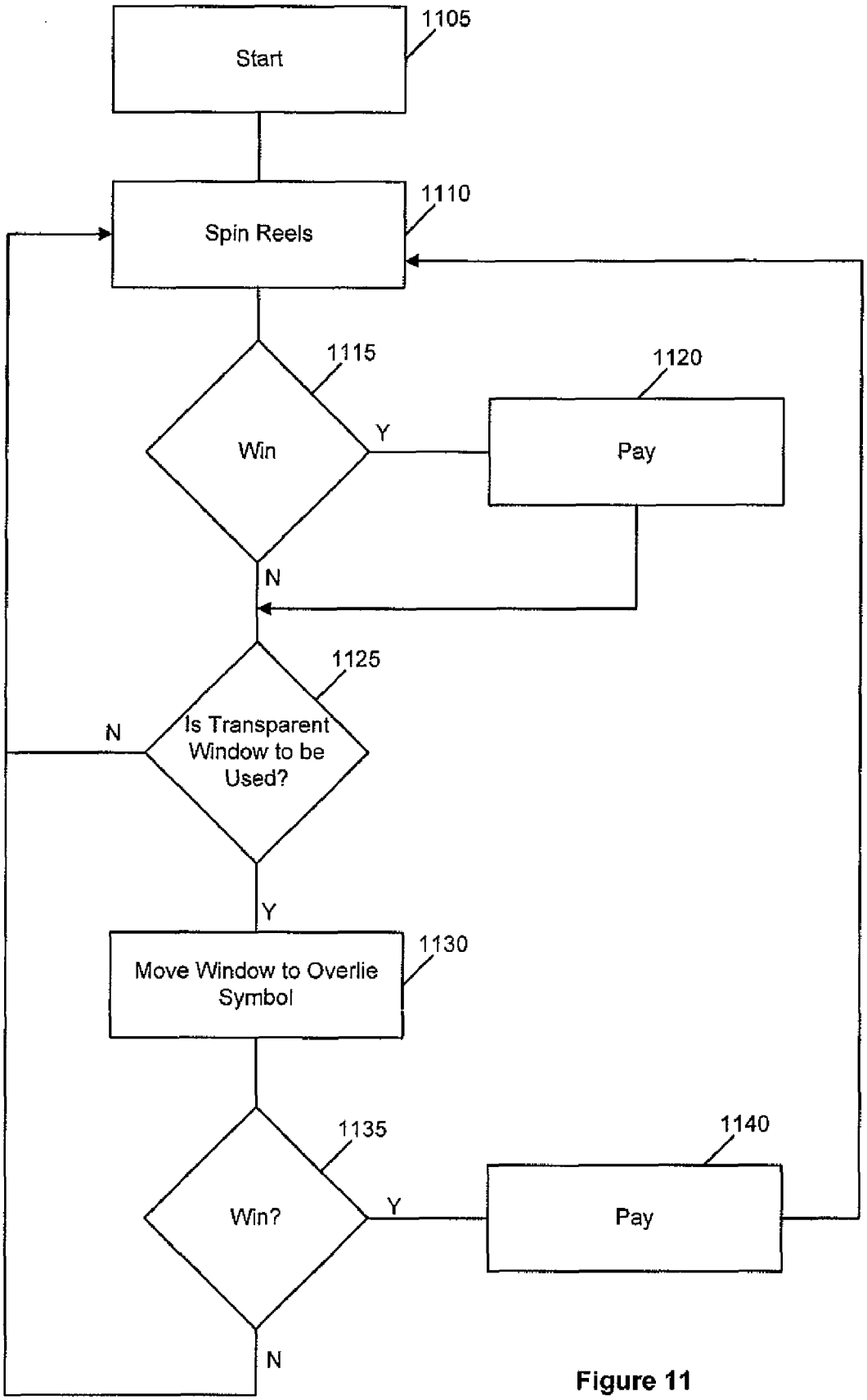
FIG. 11 is a flowchart relating to an embodiment of the invention.

With reference to FIG. 9 and FIG. 11, a display 16 of a gaming machine is shown which includes five reels 916*a* to 916*e* forming three rows 915*a*, 915*b* and 915*c* in a conventional five by three array. The symbols 910 are randomly generated by a random number generator selecting stop positions for each of a plurality of reels and are displayed as a video display on display 16. Typically, the reels 916*a* to 916*e* "spin" by moving the symbols 910 downwardly in FIG. 9 to give the appearance of a spinning reel and are stopped in turn to form the display 16. When a player plays the game, a player will normally insert coins or other forms of payment to commence a game and will spin the reels to bring up the display 16. In accordance with the rules of the game, a win may be determined based on the display. For example, the two symbols 910 in row 915*a* may result in a payout to the player.

The player also has the option of selecting whether the player will pay all three rows 915*a* to 915*c* shown in FIG. 9 or only one or two of those rows. There may also be other selections that the player can make when placing a wager, for example more win lines to select or the player may select reels rather than win lines.

When the criteria for use of the transparent window are met, transparent window 912 is generated and is located randomly over at least one of the symbols 910 to determine whether that symbol contains a hidden symbol, if so an additional payout will occur. In alternative embodiments, the position is selected by the player or the position is predetermined. In another embodiment, the transparent window could cover a plurality of symbols. For example, it could be represented as a curtain.

Thus, according to the embodiment of the invention, the display of symbols shown in FIG. 9 includes a hidden symbol 910'. The rules of the game determine whether a win occurs. As previously mentioned, the three tens in line 915*a* result in a win which is paid to the player.

Figure 10:
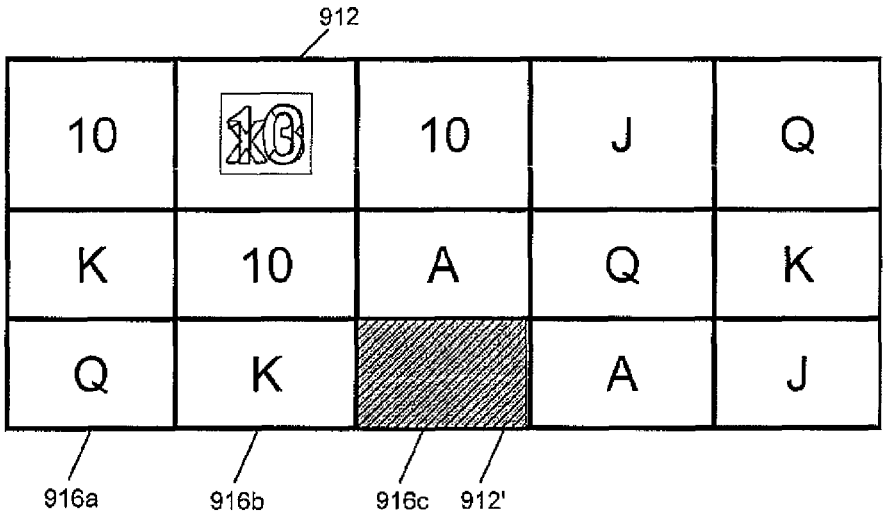
FIG. 10 is a view of the display of FIG. 9 illustrating an embodiment of the invention.

The transparent window 912 is then overlaid on one or more of the reels as shown in FIG. 10 and is spun and stopped randomly. If as shown in FIG. 10 the transparent window 912 reveals a hidden symbol such as X3 in FIG. 10, three times the payout previously provided is paid to the player. Thus, the player has a first chance to win based on the display in FIG. 16 and a second chance once the window 912 is brought into play.

In one embodiment as shown in FIG. 10, two separate overlay windows are used and overlay two of the reel strips of reels 16*b* and 16*c* in FIG. 10. The overlay window marked 912' in FIG. 10 which overlays the reel 16*c* does not result in any win because no hidden symbol is revealed.

In one embodiment of the invention, the transparent window 912 may include an overlay reel strip on two or more of the reels 16*a* to 16*e* and may be spun and stopped in a position over the symbols on two or more of the reels 16*a* to 16*e*.

The transparent window 912 can be bought into play automatically when a player reaches a certain stage of the game, in response to a trigger condition being met, in response to a purchase by a player, or randomly at some stage of a game.

In another embodiment, rather than provide the transparent window 912 as a transparent window on an overlay on one of the reels, the transparent window 912 may be a roaming window which simply remains static as shown in FIG. 9 or moves around the display 16, and then moves randomly to locate on one of the symbols 910.

The transparent windows 912 may be restricted to an individual reel strip formed by the periphery of one of the reels 916*a* to 916*d* or may be an overlay reel strip which overlays two or more of the reels 916*a* to 916*e*.

Figure 12:
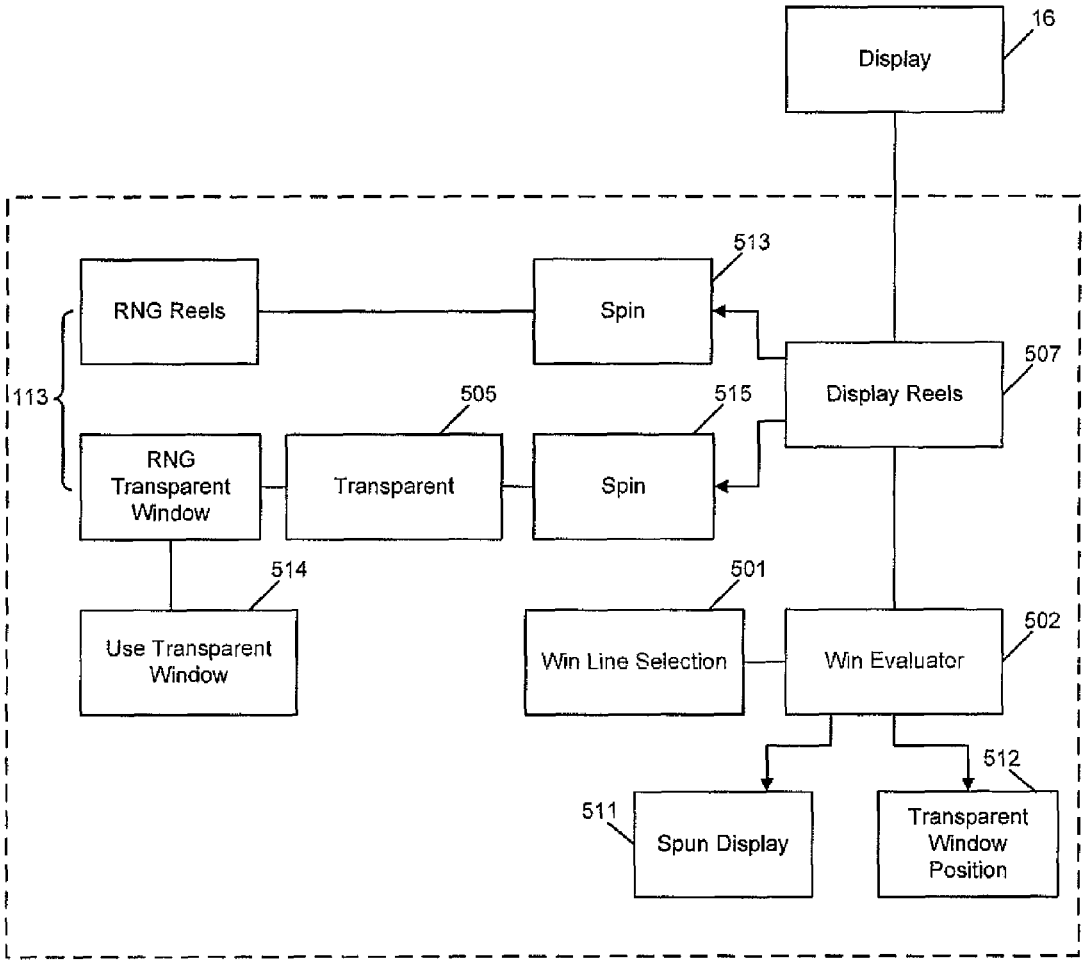
FIG. 12 is a functional block module diagram relating to an embodiment of the invention.

FIG. 11 is a flow chart explaining operation of an embodiment and FIG. 12 is a functional modular block diagram illustrating the operation of the embodiment. In Random number generators 113 generate the symbols 910 which form the display 16 by selecting stopping positions for each of a plurality of reels. When the transparent window is to be used 1125. The random number generators 113 also select the position at which the transparent window 912 will stop and overlay one of the symbols 910. After a game is started 1105, the reels strips defining symbols are spun 1110 by module 513, and the symbols selected by the random numbered generators are provided by display reel module 507 for display on the display 16. The module 514 determines if the transparent window is to be used 1125 based on the rules of the game. The position 1130 for the transparent window is selected if appropriate under control of transparent window module 505 such that the window is moved to that position under control of display module 507. In embodiments, where the transparent window is spun, the spin module 515 spins the transparent window and stops the window at one of the symbols on display 16. Wins are determined 1115,1120 by the evaluation module 502 based on the original display and then the modified display with the overlay window 912. In one embodiment, wins are determined by storing the position of the symbols in FIG. 9, in particular those which have hidden symbols so that when the stop position of the transparent window is determined, that position is recorded by module 512. If there is a match between the position of the transparent window 512 and a hidden symbol in the spun display recorded by module 511, then the win previously provided to the player is modified in accordance with the hidden symbol. This may pay 1140 a multiplier such as three times the payout 1120 previously awarded or some other additional reward to the player. The module 501 allows the user to choose whether one, two or three win lines are being played. Persons skilled in the art will appreciate that in other embodiments, there may only be a single pay—i.e. pays are made only after the transparent window has been positioned.

Whilst in the embodiment described the display is in the form of a video display which simulates the movement of reels 916*a* to 916*d* by virtue of a video display, the display 16 could be a mechanical reel system in which reels are spun by a motor. In this embodiment, the overlay window 912 would include an overlay strip on one or more of the reels which is movable independently of the reel strips containing the symbols 910.

It is to be understood that, if any prior art publication is referred to herein, such reference does not constitute an admission that the publication forms a part of the common general knowledge in the art, in Australia or any other country.

In the claims which follow and in the preceding description of the invention, except where the context indicates otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings. The present invention contemplates methods, systems and program products on any electronic device and/or machine-readable media suitable for accomplishing its operations. Certain embodiments of the present invention may be implemented using an existing computer processor and/or by a special purpose computer processor incorporated for this or another purpose or by a hardwired system, for example.

Embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

Method steps associated with certain embodiments may be implemented in one embodiment by a program product including machine-executable instructions, such as program code, for example in the form of program modules executed by machines in networked environments. Generally, program modules include routines, programs, objects, components, data structures, etc., that perform particular tasks or implement particular abstract data types. Machine-executable instructions, associated data structures, and program modules represent examples of program code for executing steps of the methods disclosed herein. The particular sequence of such executable instructions or associated data structures represents examples of corresponding acts for implementing the functions described in such steps.

The invention claimed is:

1. A method of gaming comprising:

selecting a plurality of symbols for respective displaying at respective ones of a plurality of display positions, the plurality of symbols being selected from a set of symbols having at least one symbol which comprises a visible symbol and a hidden symbol; and selecting at least one of the plurality of display positions and locating an overlay, which is separate from the at least one symbol and the selected display, over the selected display position to determine whether the symbol displayed in the selected display position comprises a hidden symbol, wherein the overlay is arranged such that when overlaid over the display position, the visible symbol is concealed and any hidden symbol is revealed; wherein the overlay comprises a transparent window of a predetermined colour and the hidden symbol is a different colour to the predetermined colour, the visible symbol being the same colour as the predetermined colour.

2. The method of claim 1, wherein the at least one symbol comprises a plurality of symbols, at least one of the plurality of symbols comprising the visible symbol and the hidden symbol, the symbols being arranged in a reel format having a plurality of reel strips each comprised of some of the symbols to thereby form at least one row of symbols.

3. The method of claim 2, wherein the plurality of symbols, including the visible symbol, form a group of symbols to determine a game outcome, and the overlay, when located on the hidden symbol, modifies the game outcome.

4. The method of claim 1, wherein the overlay comprises an overlay on a reel strip overlaying one of the said reel strips.

5. The method of claim 1, wherein the overlay comprises a roaming overlay.

6. A game controller for a gaming system, the game controller arranged to:

select a plurality of symbols for respective display at respective ones of a plurality of display positions, the plurality of symbols being selected from a set of symbols having at least one symbol which comprises a visible symbol and a hidden symbol; and select at least one of the plurality of display positions and locate an overlay, which is separate from the at least one symbol and the selected display position, over the selected display position to determine whether the symbol displayed in the selected display position comprises a hidden symbol wherein the overlay is arranged such that when overlaid over the display position, the visible symbol is concealed and any hidden symbol is revealed;

wherein the overlay comprises a transparent window of a predetermined colour and the hidden symbol is a different colour to the predetermined colour, the visible symbol being the same colour as the predetermined colour.

7. The controller of claim 6, wherein the at least one symbol comprises a plurality of symbols, at least one of the plurality of symbols comprising the visible symbol and the hidden symbol, the symbols being arranged in a reel format having a plurality of reel strips each comprised of some of the symbols to thereby form at least one row of symbols.

8. The controller of claim 7, wherein the plurality of symbols, including the visible symbol, form a group of symbols to determine a game outcome, and the overlay, when located on the hidden symbol, modifies the game outcome.

9. The controller of claim 6, wherein the overlay comprises an overlay on a reel strip overlaying one of the said reel strips.

10. The controller of claim 6, wherein the overlay comprises a roaming overlay.

11. The controller of claim 6, implemented by a processor executing program code stored in a memory.

12. A gaming system comprising:

a player interface comprising a display for displaying game outcomes;

and a game controller arranged to:

select a plurality of symbols for respective display at respective ones of a plurality of display positions, the plurality of symbols being selected from a set of symbols having at least one symbol which comprises a visible symbol and a hidden symbol; and select at least one of the plurality of display positions and locate an overlay, which is separate from the at least one symbol and the selected display position, over the selected display position to determine whether the symbol displayed in the selected display position comprises a hidden symbol, wherein the overlay is arranged such that when overlaid over the display position the visible symbol is concealed and any hidden symbol is revealed;

wherein the overlay comprises a transparent window of a predetermined colour and the hidden symbol is a different colour to the predetermined colour, the visible symbol being the same colour as the predetermined colour.

13. The system of claim 12, wherein the at least one symbol comprises a plurality of symbols, at least one of the plurality of symbols comprising the visible symbol and the hidden symbol, the symbols being arranged in a reel format having a plurality of reel strips each comprised of some of the symbols to thereby form at least one row of symbols.

14. The system of claim 13, wherein the plurality of symbols, including the visible symbol, form a group of symbols to determine a game outcome, and the overlay, when located on the hidden symbol, modifies the game outcome.

15. The system of claim 12, wherein the overlay comprises an overlay on a reel strip overlaying one of the said reel strips.

16. The system of claim 12, wherein the overlay comprises a roaming overlay.

17. A computer readable medium comprising computer program code which, when executed, implements a method of gaming, the method comprising:

selecting a plurality of symbols for respective displaying at respective ones of a plurality of display positions, the plurality of symbols being selected from a set of symbols having at least one symbol which comprises a visible symbol and a hidden symbol; and selecting at least one of the plurality of display positions and locating an overlay, which is separate from the at least one symbol and the selected display position, over the selected display position to determine whether the symbol displayed in the selected display position comprises a hidden symbol, wherein the overlay is arranged such that when overlaid over the display position, the visible symbol is concealed and any hidden symbol is revealed; wherein the overlay comprises a transparent window of a predetermined colour and the hidden symbol is a different colour to the predetermined colour, the visible symbol being the same colour as the predetermined colour.

* * * * *